United States Patent [19]

Bundrick, Jr.

[11] 4,419,969

[45] Dec. 13, 1983

[54] FLEXIBLE CYLINDER-HEAD INTERNAL COMBUSTION ENGINE WITH CYLINDER COMPRESSION ADJUSTABLE FOR USE WITH AVAILABLE FLUID FUELS

[76] Inventor: Benjamin Bundrick, Jr., Rte. 3, Box 272, Slidell, La. 70458

[21] Appl. No.: 311,103

[22] Filed: Oct. 13, 1981

Related U.S. Application Data

[62] Division of Ser. No. 62,581, Jul. 31, 1979, Pat. No. 4,312,306.

[51] Int. Cl.[3] ..... F02B 75/04; F02B 75/36

[52] U.S. Cl. ..... 123/48 R; 123/48 A; 123/52 A; 123/51 R; 123/78 R; 123/78 A; 123/51 BB

[58] Field of Search ..... 123/48 A, 48 AA, 48 R, 123/48 B, 78 R, 78 A, 78 BA, 57 R, 57 B, 52 A, 57 BA, 57 BB, 51 AA

[56] References Cited

U.S. PATENT DOCUMENTS

| | | | |
|---|---|---|---|
| 1,224,814 | 5/1917 | Van Altena | 123/48 B |
| 1,332,756 | 3/1920 | Root | 123/53 B |
| 1,707,005 | 3/1929 | Hall | 123/48 B |
| 1,814,802 | 7/1931 | Herr | 123/52 A |
| 1,997,396 | 4/1935 | Sherman | 123/51 BA |
| 2,117,118 | 5/1938 | Pavlecka | 123/51 BA |
| 2,316,790 | 4/1943 | Hickey | 123/48 A |
| 2,858,816 | 11/1958 | Prentice | 123/48 B |

*Primary Examiner*—Wendell E. Burns

*Attorney, Agent, or Firm*—James B. Lake, Jr.

[57] ABSTRACT

In an internal combustion engine, two opposed pistons of equal radius are slidably mounted in a cylinder and respectively connected to cranks of unequal throws mounted for rotation at oppositely disposed cylinder ends in a common crankcase. The pistons are adjustable in opposing linear travel to define a flexible cylinder-head, the relative piston positions of piston proximity establishing a range of compressions therebetween correspondable to the respective compression-ignitions of a plurality of available fluid fuels. The cranks are gear connected and similarly offset from the cylinder's longitudinal centerline to eliminate dead centers, produce higher combustion pressures at more effective crank angles, and coordinate the pistons' relative linear speeds in exhaust, air intake, fuel injection, compression and power production in two cycle operation of the engine. A preferred embodiment of the invention connects two opposed cylinders offset oppositely from a common cranks' centerline, and with respective cylinders firing alternately.

2 Claims, 7 Drawing Figures

FLEXIBLE CYLINDER-HEAD INTERNAL COMBUSTION ENGINE WITH CYLINDER COMPRESSION ADJUSTABLE FOR USE WITH AVAILABLE FLUID FUELS

This is a division of application Ser. No. 062,581, filed July 31, 1979 now U.S. Pat. No. 4,312,306.

SUMMARY OF THE INVENTION

The invention relates generally to internal combustion engines, and more particularly to a flexible cylinder-head engine in which cylinder head compression is adjustable to the compression-ignitions of a plurality of fluid fuels available.

The prior art teaches at least three engines, the Stirring, the Junker, and the Fullager, all of which have pistons mounted in both ends of a cylinder, but in none of which is the cylinder head compression adjustable for use with a plurality of fluid fuels. Descriptions of these engines appear in the second edition of Marks Handbook. For greater power and flexibility, the invention combines its flexible cylinder-head and adjustable compression with transversely offsetting the cylinder from the cranks' common centerline in novel combination to obtain similar results by different structure and functioning more efficiently than is taught by Giles U.S. Pat. No. 1,515,946, and McWhorter U.S. Pat. Nos. 3,686,972, 3,861,239, and 4,085,628.

BACKGROUND OF THE INVENTION

It is an object of the invention to provide an internal-combustion engine with a flexible cylinder head and adjustable cylinder head compression.

It is another object of the invention to provide an internal combustion engine that can run on any of a plurality of fluid fuels.

Yet another object of the invention is to provide an internal combustion engine with multiple cylinders off-set oppositely from cranks' common centerline for two cycle operation.

DETAILED DESCRIPTION OF THE EMBODIMENTS

Figure 1:
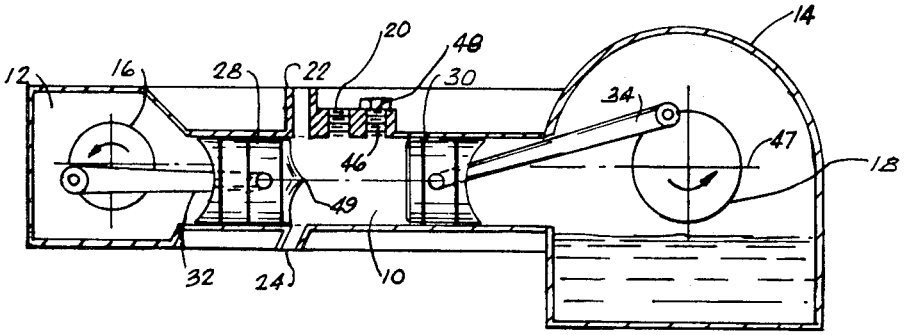
FIGS. 1–3 are diagrammatic cros-sections taken longitudinally of a basic one cylinder engine showing relative pistons' positions between cylinder firings.
Figure 2:
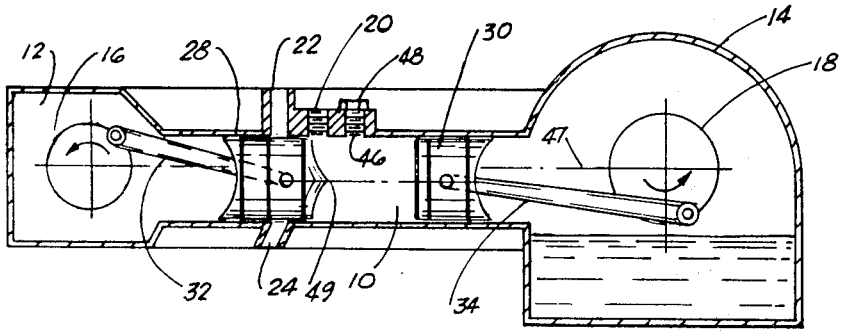
Figure 3:
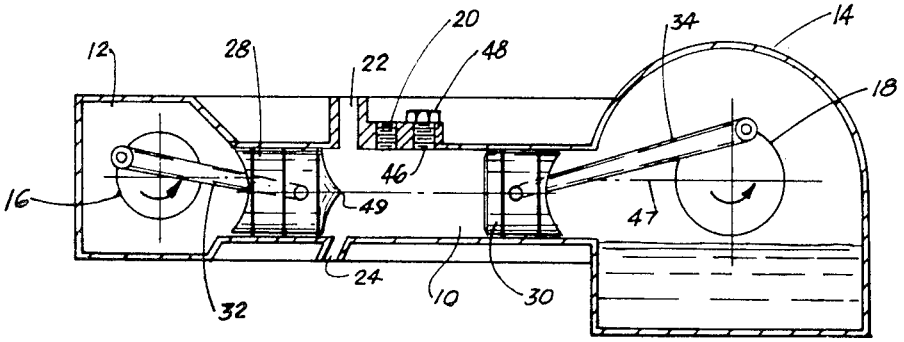

Referring to FIGS. 1–3, the basic embodiment of the invention comprises a cylinder 10 mounted on a crankcase 12 in which two oppositely disposed cranks 16 and 18 are mounted for rotation, with crank 18 having a third larger throw than crank 16, and both cranks having their respective centers on a line parallel to and offset from said cylinder's longitudinal center line. Fuel injection port 20, air inlet port 22 and exhaust port 24 are defined near cylinder end adjacent crank 16. Two pistons 28 and 30 are slidably mounted in the respective ends of cylinder 10 and connected by connecting rods

32 and 34 respectively to cranks 16 and 18, which are keyed to similar helical gears 36. Three similar gears 36 in combination with the others connect cranks 16 and 18 for rotation in the same direction and speed and their respective crankshafts 38 and 40. A frusto-conical gear 42 is connected to its associated crankshaft 40 between said crankshaft and its associated helical gear 36, the contacting surfaces of gears 36 and 42 being complementarily splined in order that said crank 36 can be backed off crankshaft 40 and out of its place in the connecting gear train and the relative positions of the respective cranks 38 and 40 be changed, thereby changing the size of a combustion chamber 44 defined between the two opposing pistons 28 and 30 at their closest approach and the compression therebetween to a compression ignition of an available fluid fuel, such as a crude oil distillate, diesel oil, kerosene, gasolene, gasohol, and acetylene, but not limited thereto.

A combustion port 46 is defined in cylinder 10 and into combustion chamber 44. Port 46 is normally closed by a plug 48 which is removable for installation of a pressure gauge (not shown) for measuring compression. Pistons 28 and 30 are of equal diameter but opposing surfaces thereof are respectively flat for piston 30 and convex for piston 28 on which a center ridge 49 projects and has sides oriented to deflect inlet air toward opposing piston 30 flat surface to assist in scavenging exhaust gases out of exhaust port 24 during the exhaust stroke part of piston 30. The respective cranks 16 and 18 are centered in a common plane 47 that is parallel to and set-off from the longitudinal centerline of cylinder 10. The resulting off-set cranks prevents crank throw alignment with connecting rods at the right and left dead centers, or what would be if not off-set, the liner travels of the pistons are greater than the orbit diameter of the cranks to give maximum power, and the reduction of pistons' linear speeds during combustion strokes results in higher cylinder pressures at more effective crank angles, and the decrease in linear speeds of the pistons between power strokes and the combination exhaust and compression strokes together with the difference in length of crank throws increases the effectiveness of the valving action of piston 28 in opening and closing of ports 20–24, in two cycle engine operation.

Figure 4:
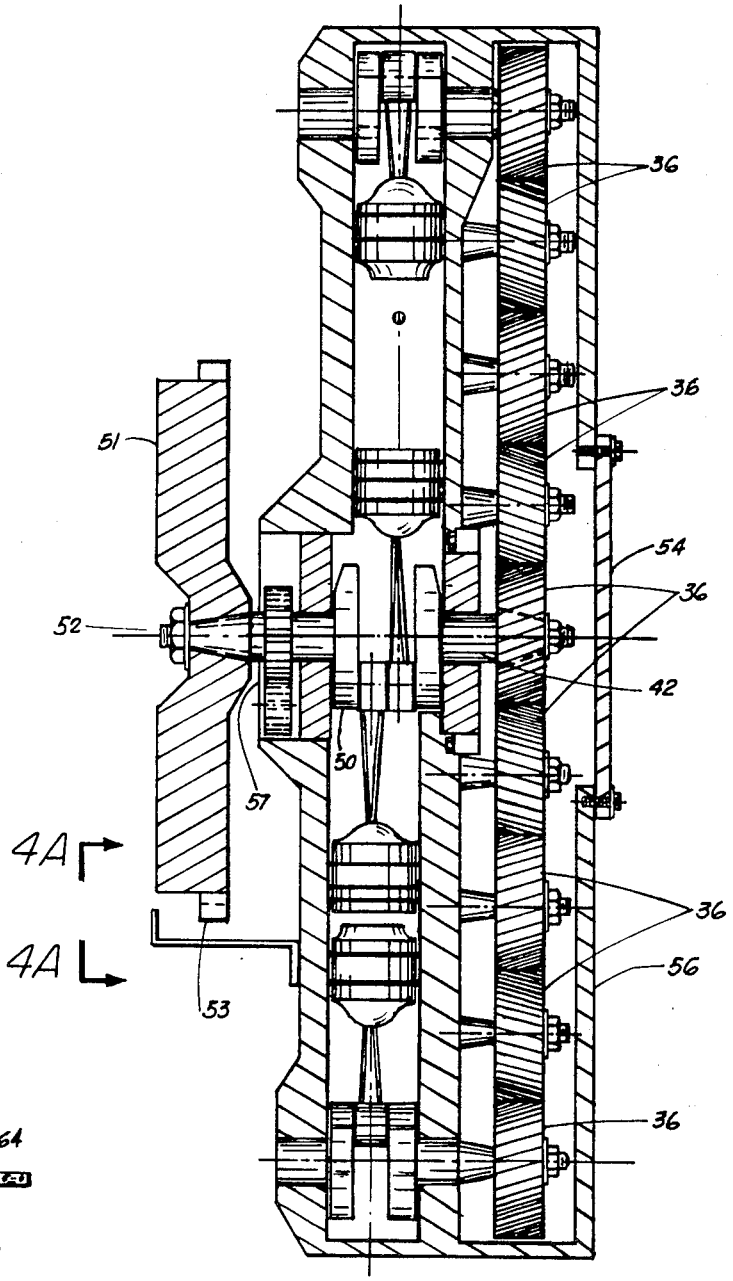
FIG. 4 is a cross section taken along section lines 4—4 of FIG. 5 of the preferred embodiment of the invention.
Figure 4A:
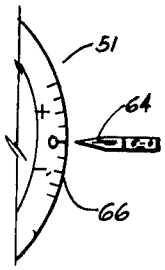
FIG. 4A is an enlarged cross-section taken along section lines 4A—4A of FIG. 4.
Figure 5:
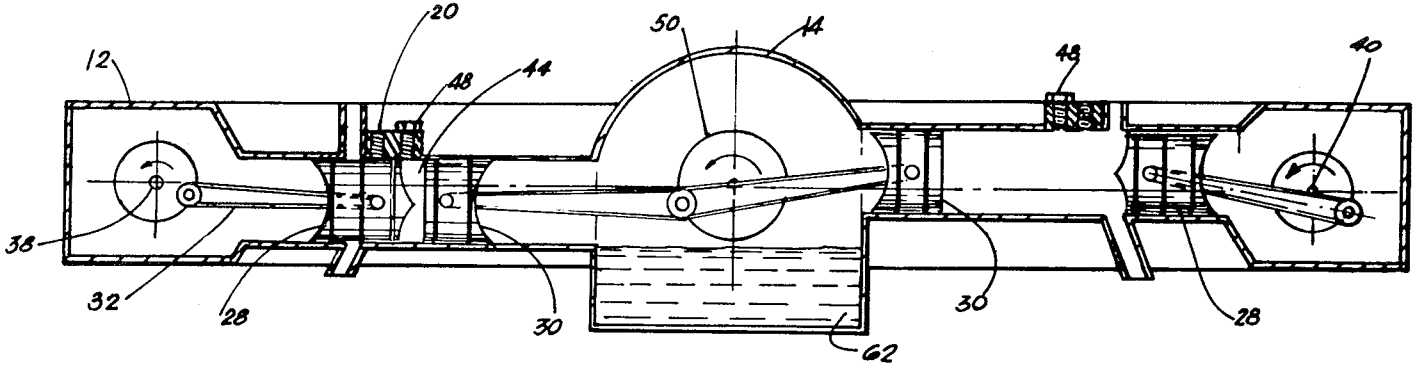
FIG. 5 is a cross section taken along section lines 5—5 of FIG. 4.
Figure 6:
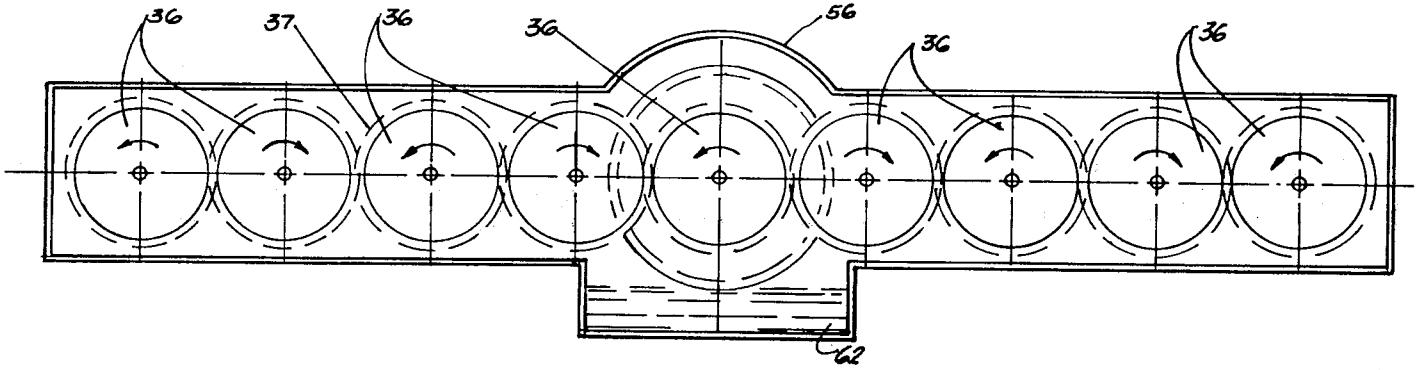
FIG. 6 is a side elevation of the engine shown in FIG. 5.

Referring to FIGS. 4–6, the preferred embodiment of the invention comprises the addition of an opposing second cyliner 10 on a common crankcase 14, with crank centers in a common plane but with cylinders 10 oppositely off-set therefrom. Inner pistons 30 are connected to a common crank 50 and move together in reciprocal linear movement, in opposite and alternate power and exhaust-compression strokes, and with the two outer pistons 28 moving oppositely to their respective inner pistons 30. In both the basic engine and the preferred embodiment, the equal and opposite combustion forces on the opposing pistons in a cylinder acting simultaneously in the firing of each cylinder lessens vibration due to combustion. A flywheel 51 is shown in FIG. 4 fixed to a center crankshaft 52 of crank 50 with a ring gear 52 for starting the engine. A hand removal plate 54 is mounted in a closure 56 opposite center helical gear 36 for backing said gear off the splined frusto-conical gear 42 and rotating crank 50 relative to cranks 16, to thereby change the relative positions of the pistons in their respective cylinders and the cylinder head compression in combustion chambers 44 to conform with a desired compression-ignition of an available fluid fuel. A relative crank setting is locked in by reinserting center helical gear 36 on the splined gear 42 and meshed with the adjacent helical gears 36 of the gear train, and removal plate 54 replaced. A oil lubricating pump 57 is driven off of a center crank shaft 60 to pump oil from a center sump 62 of crankcase 14 to the various bearings, connecting rod pins and gears more plainly seen in FIG. 4.

The engine of the invention provides four power strokes per revolution in the two cylinder preferred embodiment, and thus a high power to weight ratio. As this result is derived from only two combustions per revolution, fuel economy obtains. The adjustable cylinder head compression provides for the use of a range of fluid fuels as dictated by price and supply, and permits the engine to be operated on the Otto or diesel cycles. To operate in the Otto cycle, a carburetor is connected to the air intake port and a spark plug inserted in port 46 (neither carburetor nor spark plug is shown).

The engine of the invention can of course be operated as an air or water cooled by finning or water-jacketing the cylinders.

Engine compression can be set and changed within a range established by the ratio of piston diameter to length of piston stroke as follows:

a compression gauge is installed in combustion port 46, and flywheel 51 rotated until the gauge reads a maximum compression; a pointer 64 mounted on the front of closure 56 and extending outwardly therefrom to flywheel rim 66 indicates flywheel position which is marked on said flywheel; hand removal plate 54 is removed and center helical gear is backed off as explained heretofore and flywheel 51 is rotated for compression gauge to read a cylinder compression equal to the ignition compression of the next less volatile fluid fuel in the fuel available list and flywheel position with respect to the pointer inscribed on flywheel rim; and so one for the full range of available fuels; center helical gear is reengaged in the helical gear train and back plate replaced, and compression gauge removed and replaced by plug 48;

engine can be set to operate on any of the fuels in the available list by backing off center helical gear, rotating flywheel for the pointer and flywheel mark for the compression ignition of that fuel to coincide, replace helical gear and start up the engine.

What is claimed is:

1. A flexible cylinder-head, piston type, internal combustion engine with spaced-apart cranks comprising:

(a) a pair of oppositely disposed cylinders, each having oppositely disposed ends, oppositely and equally offset from a line through the respective centers of said spaced apart cranks that are oppositely disposed from said cylinder ends;

(b) pistons respectively mounted in said cylinder ends;

(c) piston rods respectively connecting said pistons to the respectively nearest of said cranks;

(d) similar gears mounted on said cylinders and driven in rotation by said cranks, said gears being engaged for said cranks to rotate at same speed and in same direction in two cycle operation which pistons of each cylinder moving in opposed reciprocal action and alternate combustion; and (e) mechanical means for manually disengaging and reengaging said gears, and changing the relative piston positions in said cylinders and thus cylinder compression between opposed pistons at closest proximity to an ignition compression of an available fluid fuel for the operation of said engine on said fuel.

2. A flexible cylinder head, piston type, internal combustion engine as described in claim 1 wherein alternate combustions between opposing pistons and the opposite movement incurred thereby of approximately equal masses in said cylinders practically eliminates engine vibration.

* * * * *